US012270323B2

(12) United States Patent
Andrisani et al.

(10) Patent No.: US 12,270,323 B2
(45) Date of Patent: Apr. 8, 2025

(54) HYDRAULIC CAPSULES FOR VALVETRAIN ASSEMBLY

(71) Applicant: Eaton Intelligent Power Limited, Dublin (IE)

(72) Inventors: Nicola Andrisani, Turin (IT); Majo Cecur, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/567,111

(22) PCT Filed: Jun. 10, 2022

(86) PCT No.: PCT/EP2022/025272
§ 371 (c)(1),
(2) Date: Dec. 5, 2023

(87) PCT Pub. No.: WO2022/258227
PCT Pub. Date: Dec. 15, 2022

(65) Prior Publication Data

US 2024/0263569 A1 Aug. 8, 2024

Related U.S. Application Data

(60) Provisional application No. 63/209,484, filed on Jun. 11, 2021.

(51) Int. Cl.
*F01L 1/34* (2006.01)
*F01L 1/18* (2006.01)
(Continued)

(52) U.S. Cl.
CPC ..... *F01L 1/34* (2013.01); *F01L 1/181* (2013.01); *F01L 13/06* (2013.01); *F01L 13/08* (2013.01)

(58) Field of Classification Search
CPC ..... F01L 1/34; F01L 1/181; F01L 1/24–2001/256; F01L 13/06; F01L 13/065; F01L 13/08
See application file for complete search history.

(56) References Cited

U.S. PATENT DOCUMENTS 6,694,933 B1 2/2004 Lester
7,900,597 B2 3/2011 Meneely et al.
(Continued)

FOREIGN PATENT DOCUMENTS

WO 2020/014637 A1 1/2020

OTHER PUBLICATIONS

International Search Report issued in corresponding application No. PCT/EP2022/025272 dated Sep. 23, 2022, 4 pages.
(Continued)

*Primary Examiner* — Loren C Edwards
(74) *Attorney, Agent, or Firm* — Meunier Carlin & Curfman LLC

(57) ABSTRACT

A hydraulic capsule is provided for use in connection with an engine decompression brake or other variable valvetrain lifts. The hydraulic capsule comprises a main body having a latch pin, a first housing defined by a first outer diameter, an upper chamber defined by the first housing, and a first biasing member, and the latch pin is disposed inside the upper chamber and held by the first biasing member; a second body comprising a plunger, a second housing defined by a second outer diameter, a lower chamber defined by the second housing, and means for restricting the plunger at the bottom of the lower chamber, and the plunger is slidably moveable up and down inside the second housing; a biasing means, wherein the biasing means keeps the main body and the second body in contact; and a check assembly. The first outer diameter and the second diameter can be chosen
(Continued)

according to manufacturing specifications and can be the same or different.

16 Claims, 4 Drawing Sheets

(51) Int. Cl.
*F01L 13/06* (2006.01)
*F01L 13/08* (2006.01)

(56) References Cited

U.S. PATENT DOCUMENTS

| | | | | |
|---|---|---|---|---|
| 10,907,514 | B2 | 2/2021 | Contarin et al. | |
| 11,339,690 | B2 | 5/2022 | Vanwingerden et al. | |
| 2010/0024767 | A1* | 2/2010 | Meneely | F02D 13/04 123/323 |
| 2012/0186546 | A1* | 7/2012 | Cecur | F02D 13/04 123/90.15 |
| 2021/0131318 | A1* | 5/2021 | Vanwingerden | F01L 1/047 |

OTHER PUBLICATIONS

Written Opinion issued in corresponding application No. PCT/EP2022/025272 dated Sep. 23, 2022, 7 pages.

* cited by examiner

HYDRAULIC CAPSULES FOR VALVETRAIN ASSEMBLY

CROSS-REFERENCE TO RELATED APPLICATIONS

This is a national stage application of PCT international application no. PCT/EP2022/025272, filed on Jun. 10, 2022, which claims priority to U.S. provisional application 63/209,484 filed on Jun. 11, 2021, which is incorporated herein by reference in its entirety.

FIELD OF TECHNOLOGY

The present invention relates to hydraulic capsules for variable valve lift (VVL) in valvetrain assemblies for internal combustion engines. The working examples comprise hydraulic capsules used in the valvetrain assembly for decompression brake and bleeder braking.

BACKGROUND

The decompression brake, also known as compression release engine brake or compression brake, is an engine braking mechanism installed on internal combustion engines. The decompression brake usually has a hydraulic system using engine oil which transfers the motion of the rocker arm to the engine's exhaust valve(s). When the decompression brake is activated by the rocker arm, it opens exhaust valves to the cylinders and releases the compressed gas trapped in the cylinders so that the energy is not returned to the crankshaft and the vehicle is slowed down. When used properly, the decompression brake can assist a vehicle to maintain or reduce speed with minimal use of the service brakes.

The decompression brake can be a bleeder brake, which can be used as auxiliary brakes in addition to wheel brakes on relatively large vehicles, for example trucks, powered by heavy or medium duty diesel engines. A bleeder brake typically includes a piston that selectively extends to a full stroke, where the piston can maintain an exhaust valve open a fixed amount throughout an engine cycle.

An engine brake capsule can be used for engine brake, which is fixed to a housing and comprises a channel for receiving the engine oil, a plunger that extends and configured to act on the engine valve when pressurized engine oil reaches the capsule, and an arrangement that is configured to prevent the plunger to collapse under load. The capsule can be fixed to the housing via threads, but the load on the threads can generate compressing load on the housing. Further, the dimensions of the outer diameter (OD) of the capsule depends on the balancing of the force of the oil pressure on the arrangement, any spring force, and the force when the plunger is under load. These cause the full assembly of the engine brake capsule to be quite large.

The description of the background provides the context of the present disclosure, while works of the inventors, to the extent it is described in the section, are not admitted as prior art against the present disclosure, whether expressly or impliedly.

SUMMARY OF INVENTION

To solve the problem of the engine brake capsule, the present disclosure provides a 2-piece hydraulic capsule that is compact in design and eliminates several aspects of compressing load on the housing. Design freedom is also gained, as the 2-piece hydraulic capsule can have different outer diameters on each of the 2 pieces with a balance of forces, such as spring force, oil pressure, etc. tailored to each of the 2 pieces. Then, the engine brake capsule size and material use can be reduced over prior designs, as one half of the 2 pieces can have a large diameter while the other half can be of a reduced diameter. When the outer diameters of the 2 pieces are the same, the 2-piece design aids in reducing scrap rate and furthers select-fit assembly techniques.

The hydraulic capsule of the present disclosure comprises a main body, the main body comprising a latch pin, a first housing defined by a first outer diameter, an upper chamber defined by the first housing, and a first biasing member, wherein the latch pin is disposed inside the upper chamber and held by the first biasing member; a second body, the second body comprising a plunger, a second housing defined by a second outer diameter, a lower chamber defined by the second housing, and means for restricting the plunger at the bottom of the lower chamber, wherein the plunger is slidably moveable up and down inside the second housing; a biasing means, wherein the biasing means keeps the main body and the second body in contact; and a check assembly, the check assembly comprising a check, a seat, and a second biasing member, wherein the check moves inside a passage in the lower chamber and is biased by the second biasing member against the seat, and the check moves upward to close the passage.

In the hydraulic capsule of the present disclosure, the first outer diameter of the first housing can be the same or different from the second outer diameter of the second housing.

The hydraulic capsule of the present disclosure can further comprise a supporting body, and the supporting body comprises an upper portion and a lower portion with a bore. The first housing can be fixed to the upper portion of the supporting body, and the plunger is slidable inside the bore of the lower portion.

In the hydraulic capsule of the present disclosure, the second housing of the second body can not be fixed to the supporting body.

In the hydraulic capsule of the present disclosure, the capsule can be connected to an oil channel and in fluid communication with the oil channel; and can be configured to bring pressurized oil from the oil channel to the inside of the capsule to push the latch pin upward and to extend the plunger to a stroke.

In the hydraulic capsule of the present disclosure, the biasing means can be a biasing spring.

The hydraulic capsule can further comprise means for transferring an axial force of the biasing spring to the second body.

In the hydraulic capsule of the present disclosure, the first housing and the second housing can be respectively fixed to a bore of a valvetrain component.

The hydraulic capsule can further comprise a first oil supply channel connecting the oil channel to the upper chamber, and a second oil supply channel connecting the oil channel to the lower chamber, wherein oil supply in the oil channel is controlled by an oil control valve to supply oil respectively to the upper and lower chambers. The oil supply in the oil channel can be controlled by an oil control valve to supply oil alternately to the upper and lower chambers.

In the hydraulic capsule of the present disclosure, the main body and the second body can be respectively fixed to a bore of a valvetrain component. The main body can be fixed to a bore of a valvetrain component by a first means, and the second body can be fixed to the bore of the valvetrain component by a second means. The first means can be a threaded nut or threading structure in the bore, and the second means can be a snap ring or a stop armature at the bottom of the lower housing.

The hydraulic capsules of the present disclosure can be used for variable valve lift (VVL) in a valvetrain, and the variable valve lift can comprise, for examples, Engine Braining (EB), cylinder deactivation (CDA), or early or late valve opening or closing techniques. Such hydraulic capsule can withstand operating pressures of heavy duty vehicles, medium duty vehicles, or light duty vehicles. The hydraulic capsule can be used for decompression engine brake and other types of variable valve lifting where collapsible capsule could perform the function, including, but not limited to, type V engines, valvetrain, rocker arms, towers, and carriers. The hydraulic capsule of the present disclosure is compact and has low cost for production.

BRIEF DESCRIPTION OF THE DRAWINGS

FIG. 3A shows the hydraulic capsule being installed with a rocker arm, and FIG. 3B shows the components of the hydraulic capsule that can be dropped inside a bore from top to bottom.

Reference numbers in the figures refer to the following structures: 10: main body; 11: first biasing member; 12: first housing; 13: latch pin; 14: upper chamber; 20: supporting body; 21: shim; 22: travel stop (stake or clip); 23: oil channel; 24: biasing means; 25: check assembly; 26: seat; 27: passage; 28: check; 29: bore; 30: second body; 31: second biasing member; 32: second housing; 33: plunger; 34: lower chamber; 35: clip or stop; 41: rocker arm body; 42: roller; 43: opening; 231: first oil supply channel; 232: second oil supply channel.

DETAILED DESCRIPTION OF INVENTION

The two-piece hydraulic capsule of the present disclosure is further described in detail in connection with the drawings. One of ordinary skill in the art would modify the hydraulic capsule of the present disclosure without departing from the scope of protection of present disclosure.

Figure 1:
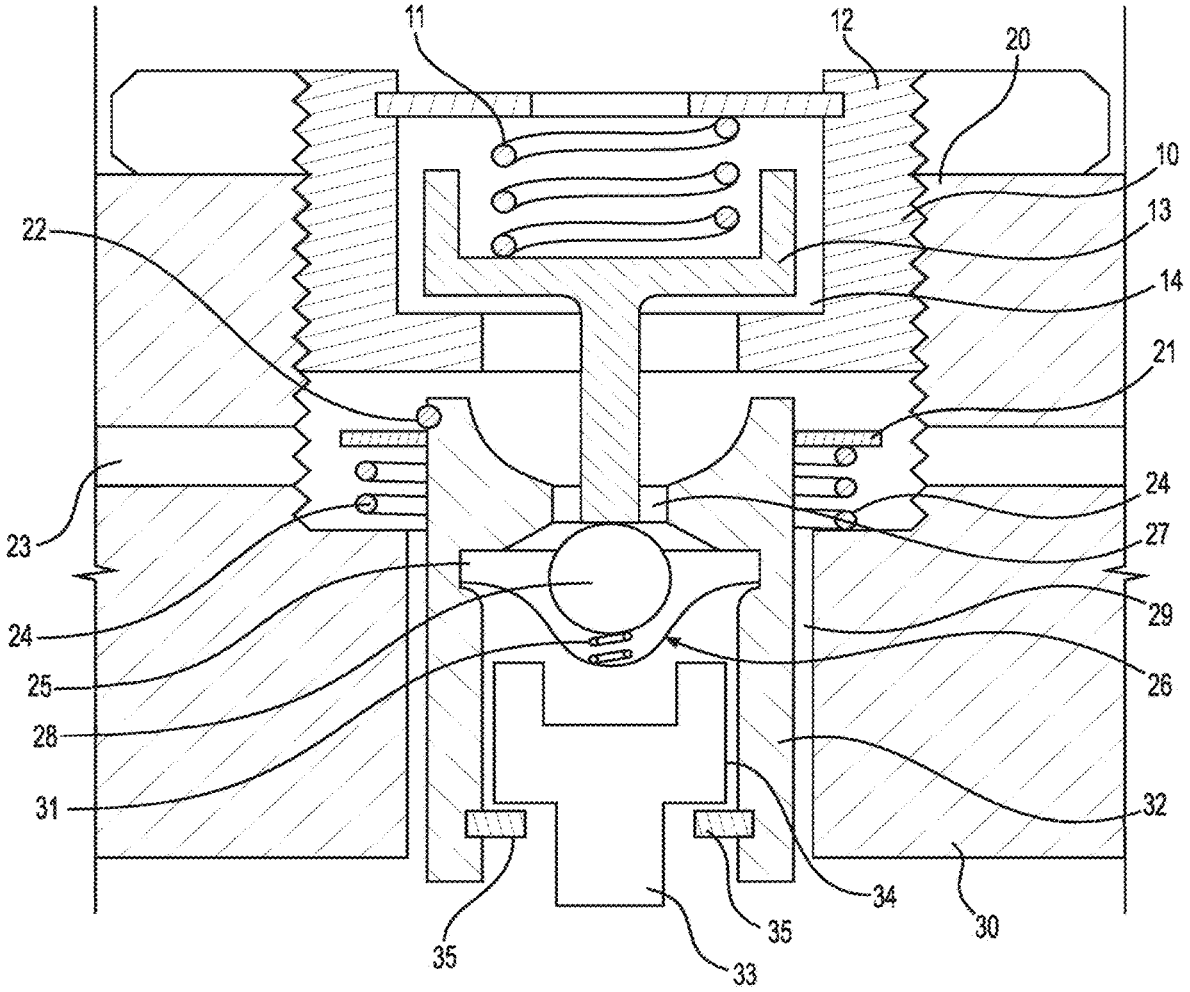
FIG. 1 shows the two-piece hydraulic capsule of the present disclosure, have the plunger in an extended position.
Figure 2:
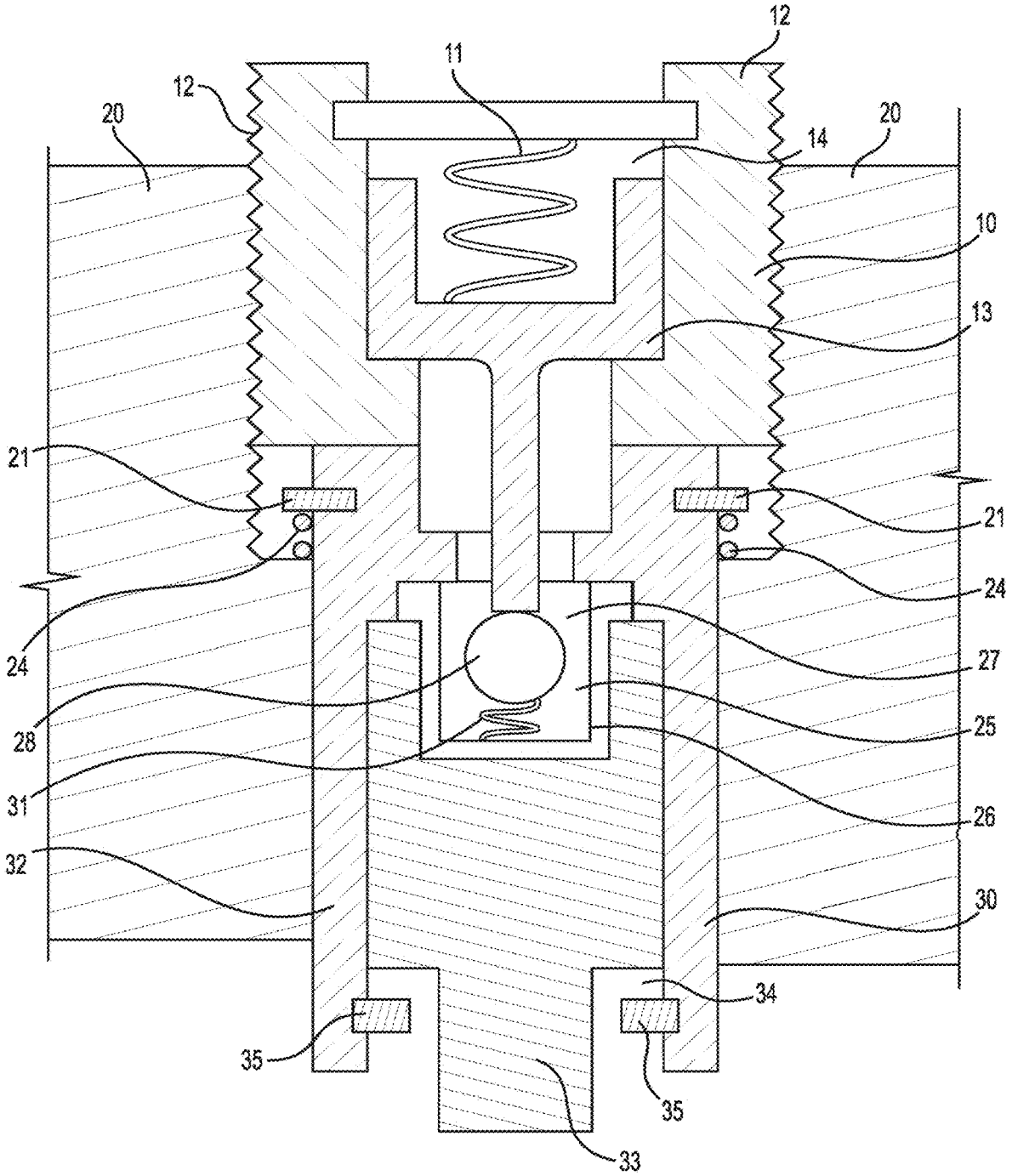
FIG. 2 shows the two-piece hydraulic capsule of the present disclosure, have the plunger in a retracted position.

As shown in FIGS. 1 and 2, the hydraulic capsule of the present disclosure is a two-piece hydraulic capsule that comprises main body 10, secondary body 30, biasing means 24 that holds the main body 10 and secondary body 30 in contact, and a check assembly 25. The main body 10 comprises latch pin 13, the first housing 12 defined by the first outer diameter, an upper chamber 14 defined by the first housing 12, and the first biasing member 11. The latch pin 13 and the first biasing member 11 are disposed inside the upper chamber 14, and the first biasing member 11 is configured to bias the latch pin 13 downward toward the lower chamber 34.

The second body 30 comprises plunger 33, the second housing 32 defined by a second outer diameter, a lower chamber 34 defined by the second housing 32, and means for restricting the plunger at the bottom of the lower chamber. In the embodiments shown in FIGS. 1 and 2, the means for restricting the plunger at the bottom of the lower chamber is a clip or stop 35. The plunger 33 is configured to slide along the lower chamber 34 up and down between an extended position as shown in FIG. 1 and a retracted position as shown in FIG. 2. A clip or stop 35 is configured to limit the downward movement of plunger 33.

The biasing means 24 keeps the main body 10 and the second body 30 in contact. The biasing means 24 can be a biasing spring.

The check assembly 25 is disposed in the lower chamber 34 and comprises check 28, seat 26, and the second biasing member 31. The check 28 can be a ball, a sheet material, a block, or other device configured to move in the lower chamber 34. The second biasing member 31 can be a biasing spring, which is configured to bias the check 28 toward the upper chamber 14 to seal the passage 27. In the illustrated example, a check ball is biased to abut a shoulder formed in second housing 32 to seal the passage 27. The biasing spring is a coil spring, but could also be a leaf spring or wave spring. The check assembly 25 can also comprise a cage forming a seat 26 to position the second biasing member 31 and check 28. The seat 26 can be positioned in an optional groove of second housing 32.

Figure 4:
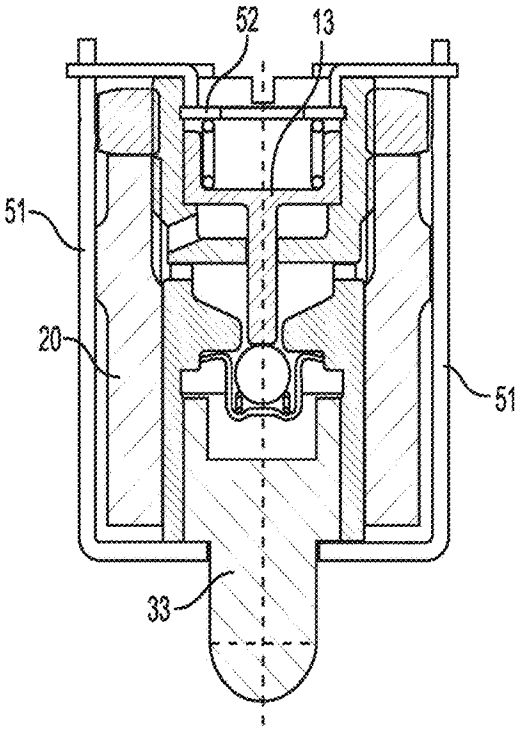
FIG. 4 shows structure of the two-piece hydraulic capsule of the present disclosure being held in the bottom holding armature and top leaf spring.

In one embodiment, the hydraulic capsule of the present disclosure is used as an engine brake capsule operable in a drive mode and a brake mode. In the drive mode, pressurized fluid is not supplied to the capsule, in particular to the lower chamber 34 such that plunger 33 is collapsed or retracted into the lower chamber 34 (FIG. 2). In brake mode, pressurized fluid (e.g., engine oil) is supplied to the capsule via one or more ports. The pressurized fluid enters and fills lower chamber 34 via passage 27 as latch pin 13 biases check 28 downward. This forces plunger 33 downward into the extended position (FIG. 1) to contact the engagement surface to facilitate performing a bleeder brake operation. As shown in FIGS. 3B and 4, the plunger 33 can be configured to accommodate an E-foot, or of a spherical or cylindrical end as contact with other valvetrain components. Other variable valve actuation techniques can be implemented besides engine braking. For example, the plunger can be controlled for enabling extended lift events like late intake valve closing (LIVC) or early exhaust valve opening (EEVO) or for enabling shortened lift events like late exhaust valve opening (LEVO), or for enabling a no-lift event like cylinder deactivation (CDA), among other options.

In the hydraulic capsule of the present disclosure, the first outer diameter of the first housing can be the same or different from the second outer diameter of the second housing. The advantage of the dual-diameter hydraulic capsule of the present disclosure is that is possible to decouple the diameter requirements for the switching and the load. The outer diameter of the main body housing the latch pin can be chosen largely independent of the outer diameter of the second body housing the hydraulic element, which results in material and fluid savings.

As shown in FIGS. 1 and 2, the hydraulic capsule of the present disclosure can further comprise a supporting body 20. The supporting body 20 comprises an upper portion and a lower portion with a bore 29. The first housing 12 of the main body 10 can be fixed to the upper portion of the supporting body 20, by threaded structure as shown in FIGS. 1 and 2, and the plunger 33 is slidable inside the bore 29 of the lower portion. In the hydraulic capsule of the present disclosure, the second housing 32 of the second body 30 may not be fixed directly to the supporting body 20 as shown in FIGS. 1 and 2. The second housing 32 can "float" in the bore 29. The bore 29 can be stepped as shown in FIGS. 1 & 2, or bore 29 can comprise leak-down paths or other grooves as shown in FIG. 3A.

Hydraulic capsule can be threaded to the supporting body 20. When using a threaded nut or threading structure in the bore 29, the main body 10 can be moved up and down the bore 29 to regulate or set the lash, the threading on the threaded nut or threading between the main body 10 and the bore 29 can be used for locking the lash regulation or lash setting in place. The second body 30 can regulate and set the lash via the biasing means 24 pushing the second body 30 against the main body 10.

Figure 3A:
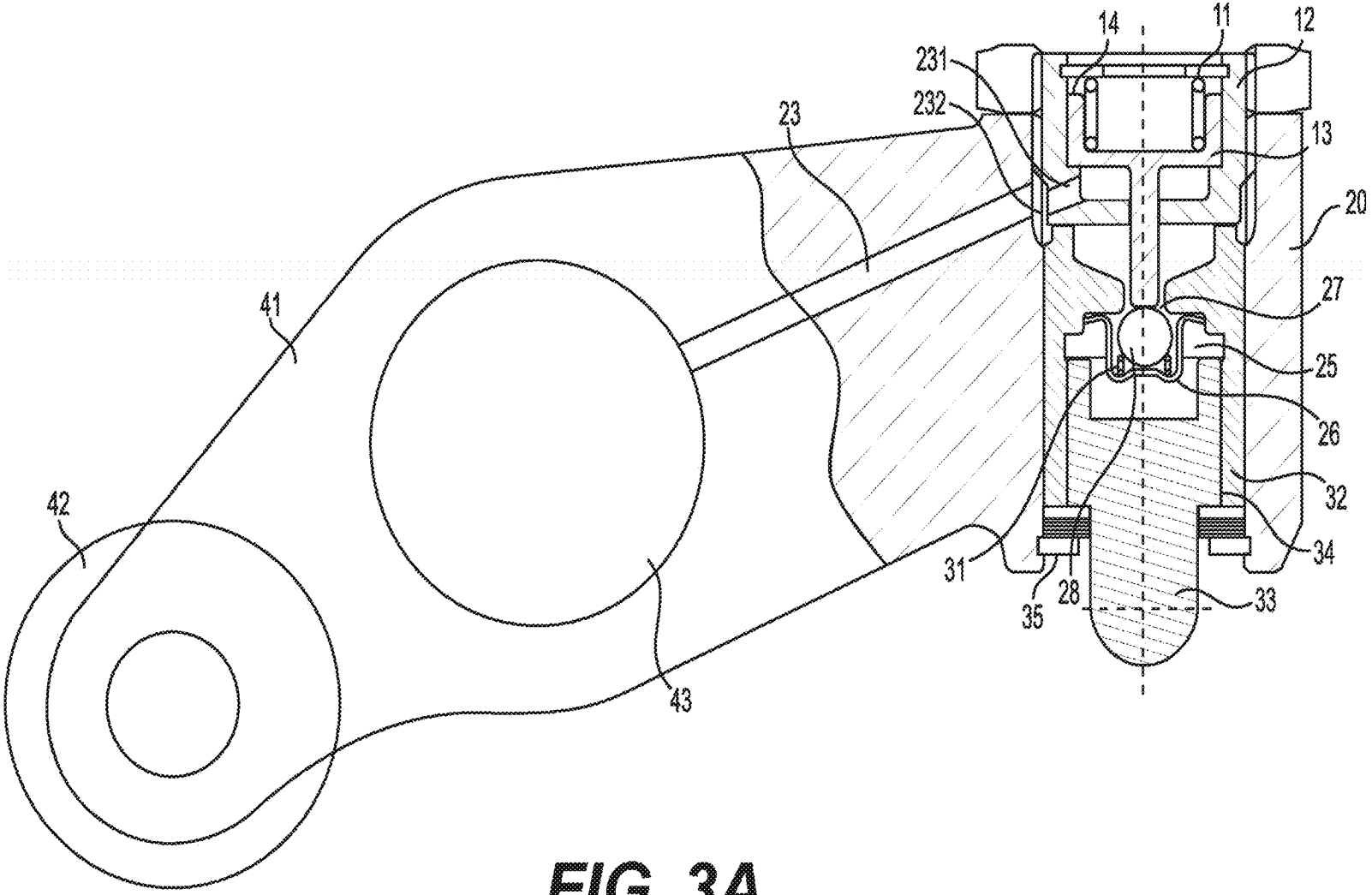
FIGS. 3A and 3B shows one embodiment the two-piece hydraulic capsule of the present disclosure where the first and second oil supply channels supply to the upper chamber and check assembly and lower chamber respectively, where
Figure 3B:
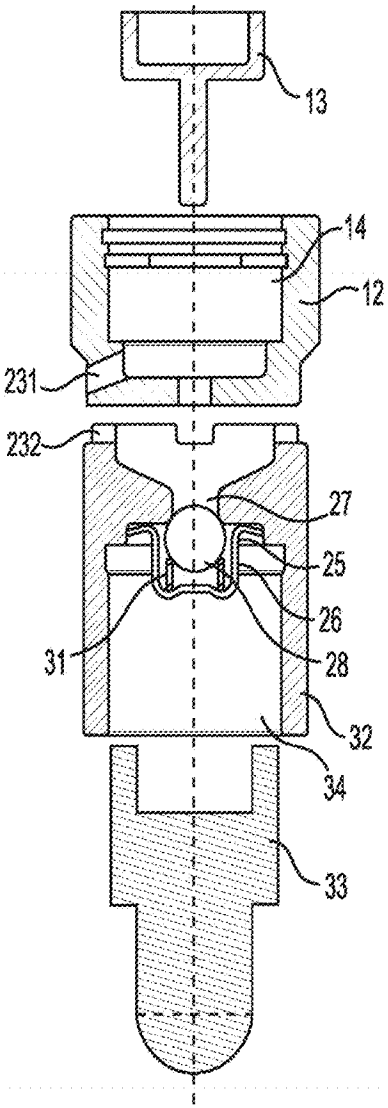

While FIG. 3A shows a rocker arm body 41 comprising the supporting body 20, it is possible to install the hydraulic capsule in other valvetrain locations, as is known in the art. For example, the hydraulic capsule can be installed in a tower in connection with a pushrod. As another example, the hydraulic capsule can be installed in a carrier on the cylinder head in mechanical connection with a rocker arm or valve bridge, among other options.

As shown in FIG. 3A, in one embodiment of the hydraulic capsule, the capsule can be connected to an oil channel 23 and in fluid communication with the oil channel 23 and in interaction and working relation to a rocker arm assembly having rocker arm body 41, roller 42, and opening 43. The hydraulic capsule can be configured to bring pressurized oil from the oil channel 23 to the inside of the capsule to push the latch pin 13 upward and to extend the plunger 33 to a stroke.

Further, as shown in FIG. 3A, the hydraulic capsule can further comprise a first oil supply channel 231 connecting the oil channel 23 to the upper chamber 14, and a second oil supply channel 232 connecting the oil channel 23 to the lower chamber 34, wherein oil supply in the oil channel 23 is controlled by an oil control valve (not shown) to supply oil respectively to the upper chamber 14 and lower chamber 34. The oil supply in the oil channel 23 can be controlled by the oil control valve to supply oil alternately to the upper and lower chambers. The split oil supply providing common or interrupted oil supply to the main body and second body allows separate functionality by the latch pin mechanism in the main body and plunger in the second body in the same hydraulic capsule.

As shown in FIGS. 1 and 2, in the hydraulic capsule of the present disclosure, the biasing means 24 can be a biasing spring such as a coil spring or wave spring. The hydraulic capsule can further comprise means for transferring an axial force of the biasing spring 24 to the second body. For example, the means for transferring the axial force can be a shim 21 such as a bushing, snap ring, washer, or integrated lip on the second housing. A travel stop 22 can optionally also be included and can comprise a stake, a clip, supporting snap ring, supporting bushing, among options.

The main body 10 and the second body 30 can be respectively fixed to the bore 29 of a valvetrain component such as a rocker arm tower interfacing with a pushrod, or a rocker arm, or a switchable valvetrain component. The main body 10 can be fixed by a first means, and the second body can be fixed by a second means. The first means can be a threaded nut or threading structure in the bore. The second means can be the shim 21 in combination with the biasing means 24. Additionally, the means for restricting the plunger 33 at the bottom of the lower chamber 34 can comprise a stop 35 such as a snap ring, bushing, or a stop armature at the bottom of the second housing 32 (FIGS. 1, 2). Or, the means for restricting the plunger 33 at the bottom of the lower chamber 34 can comprise a stop 35 such as a snap ring, bushing, or a stop armature at the bottom of the bore 29 (FIG. 3A). In either case, the stop 35 can be supplemented with washers or the like to adjust the travel of the plunger 33 in the lower chamber 34.

As shown in FIG. 3B, the components of the two-body hydraulic capsule can be arranged in a top-to-bottom matter so that they can be disposed and installed on the bore, such as that of any valvetrain components conveniently according to manufacturing specifications.

As shown in FIG. 4, the hydraulic capsule of the present disclosure can also be packed in one or more holding structures such as the leaf spring 52 on the top, the hard stop armature 51 at the bottom, or both, and ready for installation and shipment.

The description is exemplary in nature and one of skill would understand that variations are intended to be within the scope of the present invention.

The invention claimed is:

1. A hydraulic capsule, comprising:
- a supporting body, the supporting body comprising
  - an upper portion, and
  - a lower portion with a bore;
- a main body, the main body comprising:
  - a latch pin,
  - a first housing coupled to the upper portion of the supporting body and defining a first outer diameter,
  - an upper chamber defined by the first housing, and
  - a first biasing member,
  - wherein the latch pin is disposed inside the upper chamber and held by the first biasing member;
- a second body, the second body comprising:
  - a plunger,
  - a second housing movably coupled to the lower portion of the supporting body and defining a second outer diameter sized to be received within the bore,
  - a lower chamber defined by the second housing, and
  - means for restricting the plunger at a bottom of the lower chamber,
  - wherein the plunger is slidably moveable up and down inside the second housing;
- a biasing means, wherein the biasing means keeps the main body and the second body in contact; and
- a check assembly, the check assembly comprising:
  - a check,
  - a seat, and
  - a second biasing member,
  - wherein the check moves inside a passage in the lower chamber and is biased by the second biasing member against the seat, and the check moves upward to close the passage.

2. The hydraulic capsule according to claim 1, wherein the first outer diameter of the first housing is different from the second outer diameter of the second housing.

3. The hydraulic capsule according to claim 1,
wherein the plunger is slidable inside the bore of the lower portion.

4. The hydraulic capsule according to claim 3, wherein the second housing of the second body is not fixed to the supporting body.

5. The hydraulic capsule according to claim 3, wherein the supporting body comprises an oil channel that is configured to bring pressurized oil to an inside of the hydraulic capsule to push the latch pin upward and to extend the plunger to a stroke.

6. The hydraulic capsule according to claim 5, further comprising a first oil supply channel connecting the oil channel to the upper chamber, and a second oil supply channel connecting the oil channel to the lower chamber, wherein oil supply in the oil channel is controlled by an oil control valve to supply oil respectively to the upper chamber and the lower chamber.

7. The hydraulic capsule according to claim 6, wherein the oil supply in the oil channel is controlled by the oil control valve to supply oil alternately to the upper chamber and the lower chamber.

8. The hydraulic capsule according to claim 3, wherein the main body is fixed to the supporting body by a first means, and the second body is fixed to the supporting body by a second means.

9. The hydraulic capsule according to claim 8, wherein the first means is a threaded nut or a threading structure in the bore.

10. The hydraulic capsule according to claim 8, wherein the second means is a shim in combination with the biasing means.

11. The hydraulic capsule according to claim 8, wherein the means for restricting the plunger at the bottom of the lower chamber comprises a snap ring, a bushing, or a stop armature at a bottom of the second housing.

12. The hydraulic capsule according to claim 8, wherein the means for restricting the plunger at the bottom of the lower chamber comprises a snap ring, a bushing, or a stop armature at a bottom of the bore.

13. The hydraulic capsule according to claim 1, wherein the biasing means is a biasing spring.

14. The hydraulic capsule according to claim 13, further comprising means for transferring an axial force of the biasing spring to the second body.

15. The hydraulic capsule according to claim 1, wherein the first housing and the second housing are respectively fixed to a bore of a valvetrain component.

16. The hydraulic capsule according to claim 1, wherein the supporting body includes a bore of a valvetrain component.

* * * * *